United States Patent [19]

Ward et al.

[11] Patent Number: 4,863,393

[45] Date of Patent: Sep. 5, 1989

[54] MODULAR JACK ASSEMBLY WITH IMPROVED BRIDGING ARRANGEMENT

[75] Inventors: Donald A. Ward, Weatherford; George R. Steenton, Fort Worth, both of Tex.

[73] Assignee: Keptel, Inc., Tinton Falls, N.J.

[21] Appl. No.: 198,227

[22] Filed: May 25, 1988

[51] Int. Cl.[4] ..... H01R 29/00

[52] U.S. Cl. ..... 439/188; 200/51.1; 439/507; 439/676

[58] Field of Search ..... 200/51.1; 439/188, 507, 439/513–515, 676, 736, 739, 741, 744, 747

[56] References Cited

U.S. PATENT DOCUMENTS

| | | | |
|---|---|---|---|
| 4,274,691 | 6/1981 | Abernethy et al. | 439/188 |
| 4,552,423 | 11/1985 | Swengel, Jr. | 439/507 |
| 4,582,376 | 4/1986 | Olsson | 200/51.1 |
| 4,671,599 | 6/1987 | Olsson | 439/188 |
| 4,682,836 | 7/1987 | Noorily et al. | 439/507 |
| 4,699,443 | 10/1987 | Goodrich et al. | 439/676 |

FOREIGN PATENT DOCUMENTS

| | | | |
|---|---|---|---|
| 8600474 | 1/1986 | World Int. Prop. O. | 439/514 |

*Primary Examiner*—P. Austin Bradley
*Attorney, Agent, or Firm*—R. Gale Rhodes, Jr.

[57] ABSTRACT

A modular jack assembly includes a bridging card having conductors for establishing the desired bridging connections. An insert carrying the connector wires of the jack is placed in the jack such that the wires are received in edge slots of the bridging card to provide the electrical connections to the conductors on the card.

5 Claims, 2 Drawing Sheets

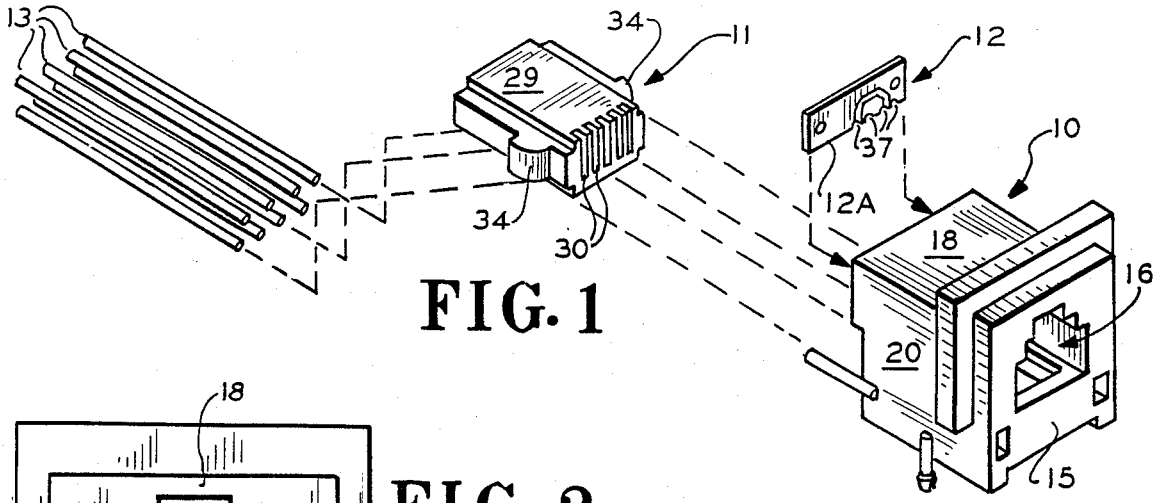
FIG. 1
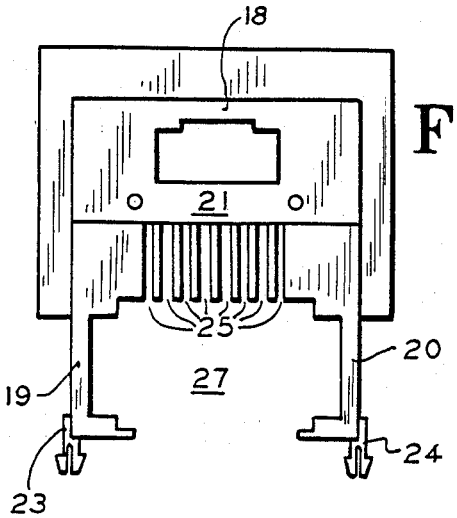
FIG. 2
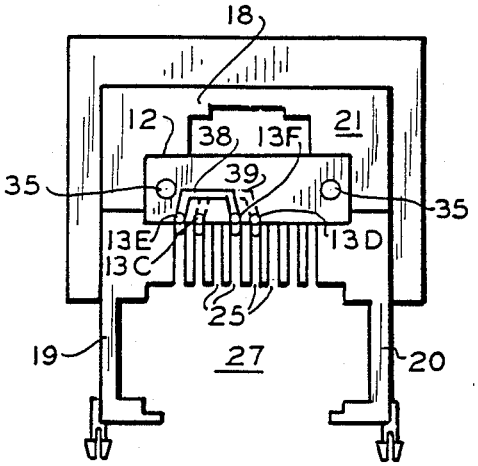
FIG. 3
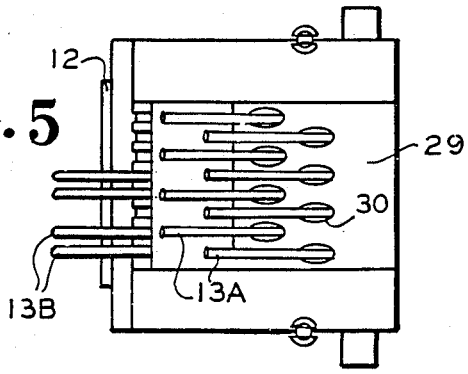
FIG. 5
FIG. 4
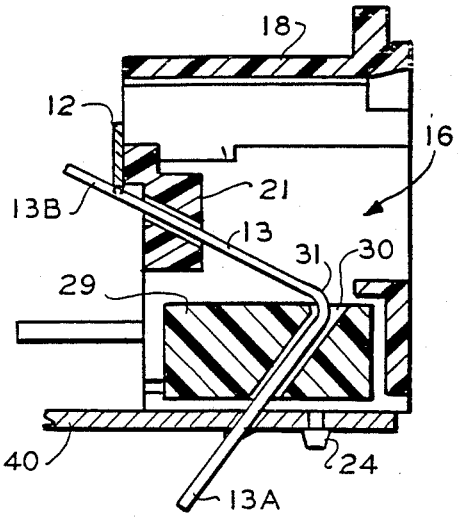
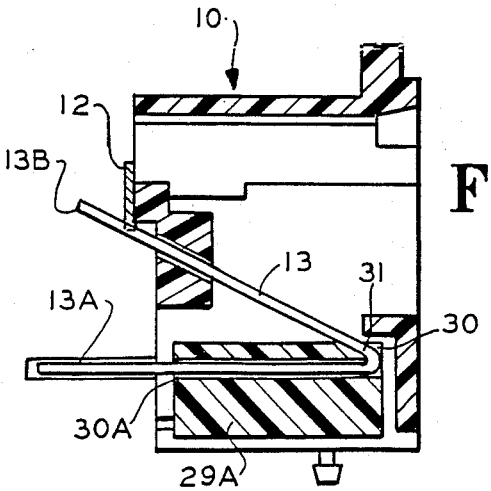
FIG. 7

MODULAR JACK ASSEMBLY WITH IMPROVED BRIDGING ARRANGEMENT

FIELD OF THE INVENTION

The present invention relates to a jack assembly of the type used to establish electrical connections for data line or telephone line connections; more particularly, the invention relates to a modular jack assembly which includes an improved bridging arrangement.

The invention is illustrated in the form of a jack adapted to receive an electrical plug. The jack is an eight-wire non-keyed receptacle for the connecting plug. Jacks of this type are used in various applications requiring that the jack assembly be compatible with different plugs for different connecting arrangements. Compatibility is achieved by effecting an internal shorting or bridging configuration within the jack itself.

The current commercial jack which permits various shorting configurations to achieve compatibility for different applications includes a 12-position (i.e., 12-wire) jack adapted to receive an eight-wire plug. The wires in the jack are arranged in side-by-side relation and the two outer pairs of wires are used to achieve the desired bridging configuration. In order to accomplish this, the two outer pairs of wires have their distal ends formed into a hook for interconnecting to establish an electrical contact with a predetermined contact point.

The current commercial version of a jack capable of various bridging arrangements is relatively bulky, despite the high desirability of jacks of small size, and it uses 12 wires, as indicated.

SUMMARY OF THE INVENTION

The present invention provides a modular jack assembly which includes a housing or block adapted to receive a conventional connecting plug. An insert is received in the block and secured by a latching interconnection with the block. Prior to assembling the insert into the block, a plurality of wires are placed in parallel channels or bores extending through the body of the insert. The wires are bent at an acute angle where they exit the insert body, so the first ends of the wires extend out of the housing for external connection to a printed circuit board, for example.

The second ends of the wires extend out of the housing in another direction where predetermined ones of the wires are received in slots formed on the edge of a bridging card or board.

The bridging card is mounted to the housing, for example by heat staking, and contains the desired bridging connections formed on opposite sides and extending into the edge slots on the card which receive the second ends of the wires.

The wires are held in electrical contact with their associated slots by spring action. Thus, when the insert is inserted, the ends of the wires desired for establishing the bridging connection are received in the edge slots on the bridging card and the wires are held against the conductors in their associated bridging slots under spring tension. The desired interconnections between predetermined wires on the insert are established by the conductor arrangement on the bridging card, much like a printed circuit board establishes connections.

Thus, the present invention provides a modular jack assembly with only eight connectors, yet one which is capable of various bridging arrangements. This has the advantage of small size, yet provides the ability to adapt the jack assembly to any new or different desired bridging arrangement.

The present invention thereby reduces manufacturing cost and improves the function of the jack by facilitating retrofitting of the jack to any new desired bridging connection. The improved jack assembly will accommodate jack housings of existing design without the need of any special adaptor or manufacturing technique.

Other features and advantages of the present invention will be apparent to persons skilled in the art from the following detailed description of preferred embodiments accompanied by the attached drawing wherein identical reference numerals will refer to like parts in the various views.

BRIEF DESCRIPTION OF THE DRAWING

FIG. 1 is an upper frontal perspective view of the improved jack assembly, with the parts shown in exploded relation;

FIG. 2 is a rear view of the housing of FIG. 1 without the bridging card;

FIG. 3 is a rear view similar to FIG. 2 but with the bridging card assembled to the housing and illustrating the shorting interconnections;

FIG. 4 is a vertical cross-sectional view of the jack assembly of FIG. 1;

FIG. 5 is a bottom view of the jack assembly of FIG. 1;

FIG. 7 is a vertical cross-sectional view of the modular jack assembly of the embodiment of FIG. 6.

DETAILED DESCRIPTION OF THE PREFERRED EMBODIMENTS

Figure 6:
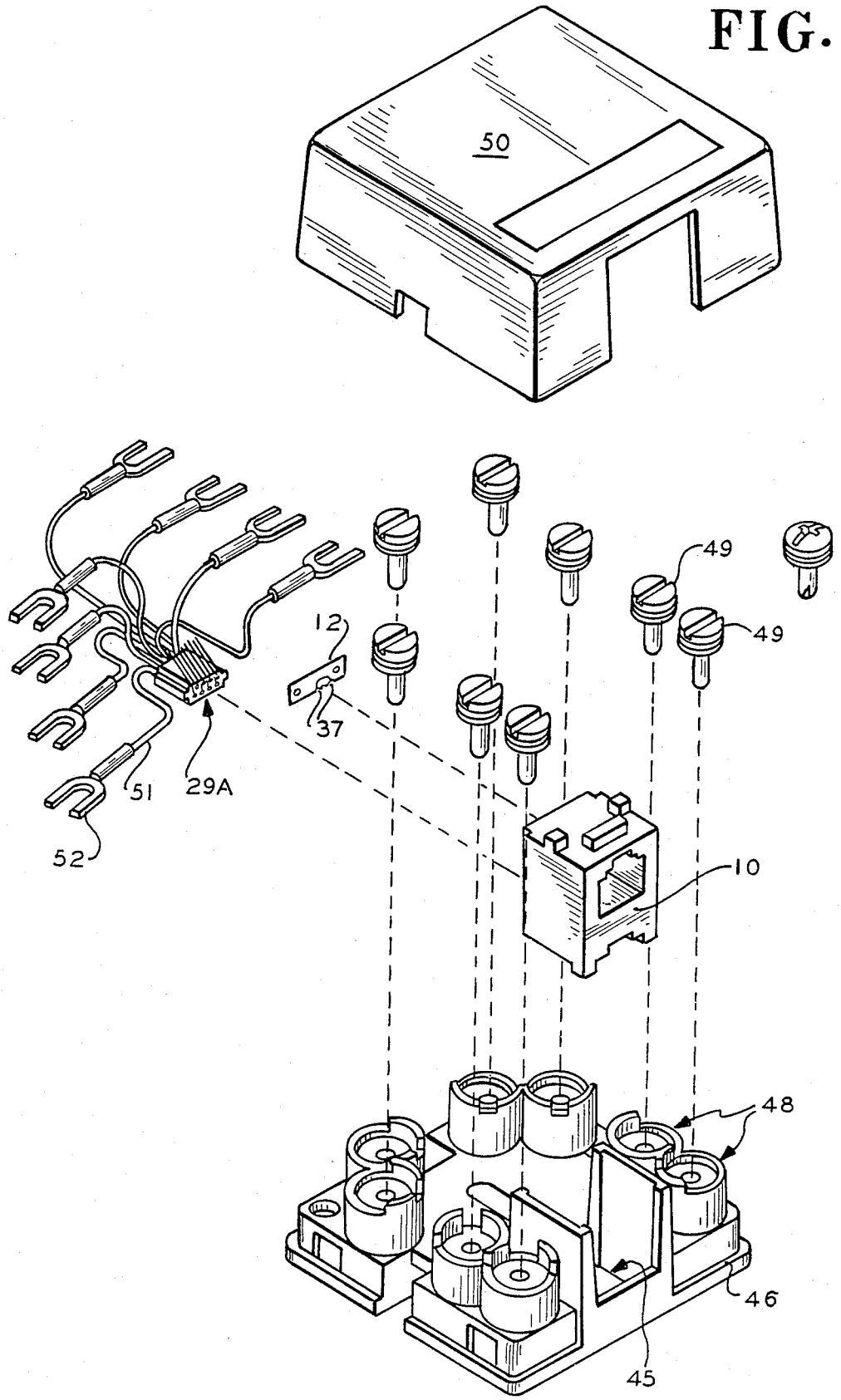
FIG. 6 is an upper perspective view of a jack assembly incorporating the present invention, with the various parts in exploded relation, and which is adapted for a prewire installation.

Referring first to FIG. 1, there is shown a modular jack assembly which incorporates the present invention with the various components in exploded relation. The jack assembly includes a housing generally designated 10, an insert generally designated 11, a bridging card 12 and a plurality of wires 13. In the illustrated embodiment, there are eight of the wires 13.

Referring first to the housing 10, it includes a front side 15 which defines a receptacle 16 for a conventional connecting plug (not shown).

Referring now to FIGS. 2 and 3, the housing 10 includes a top wall 18 and first and second side walls 19, 20 and a rear wall 21.

Integrally formed with the side walls 19, 20 are downwardly projecting bifurcated connectors 23, 24 for receiving a printed circuit board, as will be described, when it is desired to mount the housing 10 to a horizontal printed circuit board. The rear wall 21 of the housing defines a plurality of vertically-extending slots 25. There are eight of the vertical slots 25 in the rear wall 21 of the housing, one slot being associated with each of the wires 13. The rear wall 21 and housing define a cavity generally illustrated at 27 in FIGS. 2 and 3 for receiving the insert 11. In other words, the connecting plug is received in the front side of the housing 10 (in the receptacle 16) and the insert 11 is received in the rear of the housing 10.

Turning now to the insert 11, it includes a body 29 which defines a plurality of channels or bores 30 (see FIG. 4) which extend through the body 29 in an upward and forwardly inclined disposition for receiving the wires 13.

After the wires 13 exit from the top of the channel 30, they are bent at 31 in a rearward direction at an acute angle, as illustrated in FIG. 4. The lower or first ends of the wires 13 (designated 13A in FIG. 4) extend out the bottom of the insert 29, and the upper or second ends designated 13B extend out the top of the insert and toward the rear of the housing when the insert 29 is assembled to the housing. When the wires 13 are inserted in the channels 30 of the insert, and bent as described, the insert 29 is placed into the cavity 27 in the housing 10, and secured there by means of outwardly-extending projections 34 which have curved leading edges and flat rear surfaces for abutting against and latching to corresponding edges in the housing.

As seen in FIG. 4, after the wires 13 exit from the channels 30 and are bent at 31, they extend upwardly and rearwardly so that they are adapted to engage the corresponding contacts of the plug when it is received in the receptacle 16. The interconnection of the wires 13 and the plug is accomplished in a conventional manner and need not be illustrated for an understanding of the present invention.

The bridging card 12 is secured to the rear wall 21 of the housing by heat staking at 35 as seen in FIG. 3. Referring to FIG. 1, the lower edge, 12A of the bridging card 12 is provided with four slots designated 37. The slots 37 are curved in a radius to receive the wires 13.

The card 12 may be a conventional printed circuit board including a base sheet of G-10 epoxy material having a thickness of 0.020 inches with gold-plated copper conductors deposited on both sides of the board. Moreover, the conductor material is deposited in a wrap-around trace on the interior surfaces of the edge slots 37. For example, referring to FIG. 3, the bridging card 12 has a first conductor 38 deposited on the near side of the card. The conductor 38 has a wrap-around trace into the first and third edge slots from the left, thereby providing an electrical connection between the two wires 13E, 13F received in the respective ones of the vertical slots 25 in the housing.

On the far side surface of the card 12, there is a second conductor deposited which is shown partially in phantom and designated 39 in FIG. 3. The conductor 39 establishes an electrical connection between the wires 13C and 13D, both of which are received in associated ones of the slots 25 when the insert 29 is assembled into the housing as seen in FIG. 4. When thus assembled, the first ends 13A of the wires 13 extend out the bottom of the cavity 27 and may be inserted into a printed circuit card 40 having a horizontal disposition. The printed circuit card is mechanically mounted to the bottom of the housing 10 by means of the projections 23, 24. The upper ends 13B of the wires 13 may be trimmed beyond the point where they contact the wrap-around conductors on the bridging card 12. Similarly, the projecting ends 13A of the wires 13 may also be trimmed.

Turning now to the embodiment of FIGS. 6 and 7, it is adapted either for a pre-wired connection or for mounting to a vertical printed circuit board which would be located behind the housing (that is, to the left of the housing 10 in FIG. 7). In the embodiment of FIGS. 6 and 7, the housing 10 and the bridging card 12 are the same as in the first embodiment. However, the insert, designated 29A in FIG. 7, has the channels 30A which receive the wires 13 formed in a horizontal disposition so that the first ends of the wires 13A extend out the rear of the insert 29A.

It will be observed in both FIGS. 4 and 7 that the wires 13 are bent at an acute angle and, due to the inherent spring action of the wires, the first ends 13A of the wire adjacent the bend 31 react against the walls of the channels 30, while the second ends 13B of the wires 13 are urged under the spring action of the wire, induced by the bend 31, into electrical contact with the wrap-around traces of the conductors 38, 39A in the edge slots of the bridging card 12.

Turning now to FIG. 6, the housing 10 is received in a cradle 45 of a base 46. The base 46 is provided with four pairs of screw connectors, one of which is designated 48, the screws being designated 49. A cover 50 is received on the base 46 in a conventional fashion. The insert 29A is received in the rear of the housing 10; and the rear ends of the first end portions 13A of the wires 13 are attached to individual connecting wires such as that designated 51, the end of which is provided with a U-shaped connector 52 which is adapted to be secured to one of the screw connectors on the base 46.

It will thus be appreciated that by virtue of the structure which has been described, the present invention is able to accommodate the desired shorting of any two or more wires carried by the insert 29. Moreover, the invention can accommodate the shorting of two different sets of wires, each set having two or more wires, simply by extending the technique for shorting illustrated above. If it is later desired to accommodate the jack to a different shorting configuration, that, likewise, is easily accomplished and at relatively low cost simply by providing the new shorting connection on a different housing and substituting one housing for the other.

Having thus disclosed in detail two separate embodiments of the invention, persons skilled in the art will be able to substitute equivalent elements for those disclosed or to modify certain of the structure illustrated while continuing to practice the principle of the invention; and it is, therefore, intended that all such modifications and substitutions be covered as they are embraced within the spirit and scope of the appended claims.

We claim:

1. A modular jack assembly adapted to receive a multi-connector plug, comprising: a housing providing a receptacle for said plug and defining a cavity; an insert including a body of insulating material received in said cavity of said housing, said insert defining a plurality of channels extending therethrough; a plurality of wires, one for each of the channels of said insert, said wires extending through their associated channels and bent in the location where said wires exit their associated channels; and a bridging card carried by said housing and defining a plurality of slots for receiving the ends of predetermined ones of said wires; first electrical conductor means on said bridging card for establishing electrical connections between a first set of wires received in first predetermined slots on said bridging card; second electrical conductor means on said bridging card for establishing electrical connections between a second set of wires received in second predetermined slots on said bridging card; and said first and second electrical conductor means deposited on opposing sides of said bridging card and extending around a common edge thereof into said slots formed on said edge for receiving said ends of said wires.

2. The modular jack assembly of claim 1 characterized in that said wires are urged against their associated slots under spring action induced by the bending of said wires.

3. The apparatus of claim 2 wherein said channels of said insert extend in a generally upright direction, said apparatus further including a printed circuit card mounted to the bottom of said housing and receiving said wires.

4. The apparatus of claim 2 wherein said channels of said insert extend in a horizontal direction for connection to external means at the rear of said housing.

5. In a modular jack assembly including a housing adapted to receive a plug, the improvement comprising: an insert received in said housing and defining a plurality of channels extending therethrough; a plurality of wires, one received in each of said channels of said insert and bent at an acute angle where said wire exits from said housing; a bridging card carried by said housing and defining a plurality of edge slots adapted to receive selected ones of said wires in contacting relationship; first connector means on one surface of said bridging card for electrically interconnecting a first set of wires received in first predetermined ones of said edge slots; second connector means located on the opposing surface of said bridging card for electrically interconnecting a second set of wires received in second predetermined ones of edge slots; and the bend in said wires including a spring action contact of said wires with their associated connector means in said edge slots.

* * * * *